US005573052A

United States Patent [19]

Liu

[11] Patent Number: 5,573,052

[45] Date of Patent: Nov. 12, 1996

[54] POSITIONING DRUM DEVICE FOR A VENETIAN BLIND

[76] Inventor: Tai-ping Liu, No. 15, Alley 8, Lane 3, Kuochi St., Lungching Hsiang, Taichung Hsien, Taiwan

[21] Appl. No.: 580,362

[22] Filed: Dec. 28, 1995

Related U.S. Application Data

[63] Continuation-in-part of Ser. No. 370,316, Jan. 10, 1995, Pat. No. 5,538,068.

[51] Int. Cl.[6] ..... E06B 9/38

[52] U.S. Cl. ..... 160/177.2

[58] Field of Search ..... 160/173 R, 177 R, 160/176.1 R, 178.1 R, 178.3 R, 168.1 R

[56] References Cited

U.S. PATENT DOCUMENTS 2,484,804 10/1949 Burns ..... 160/176.1 R 2,589,846 3/1952 Nelson ..... 160/177 R 2,831,536 4/1958 Lorentzen ..... 160/177 R

*Primary Examiner*—David M. Purol

*Attorney, Agent, or Firm*—Kolisch, Hartwell, Dickinson, McCormack & Heuser

[57] ABSTRACT

A positioning drum device is rotatably mounted in positioning base fixedly mounted in a headrail of a Venetian blind and includes a body including a hollow top section having a closed end portion and an open end portion and having a top plate. Two channels are each longitudinally defined in the top section of the body and each terminate at the first closed end portion thereof. Two grooves are each longitudinally defined in the top plate of the top section of the body and each communicate with a corresponding one of the two channels. A plurality of wedge-shaped teeth are formed on each of two sides defining each of the two grooves. Two elongated rods are each disposed in a corresponding one of the two channels and located below an associated groove, and each have one distal end fixedly mounted on the first closed end portion of the top section of the body.

3 Claims, 4 Drawing Sheets

POSITIONING DRUM DEVICE FOR A VENETIAN BLIND

BACKGROUND OF THE INVENTION

The present invention is filed as a Continuation-In-Part application of the Applicant's own U.S. patent application Ser. No. 08/370,316, filed on Jan. 10, 1995 now U.S. Pat. No. 5,538,068.

FIELD OF THE INVENTION

The present invention relates to a positioning drum device, and more particularly to a positioning drum device for a Venetian blind.

The present invention has arisen to mitigate and/or obviate disadvantages of the conventional positioning drum device.

SUMMARY OF THE INVENTION

The primary objective of the present invention is to provide a positioning drum device which is easily assembled and has an excellent positioning function.

In accordance with one aspect of the present invention, there is provided a positioning drum device for a Venetian blind. The Venetian blind comprises a headrail having a substantially U-shaped cross-section, and at least one positioning base fixedly mounted in the headrail.

The positioning drum device is rotatably mounted in the positioning base and comprises a body including a hollow top section having a first closed end portion and a second open end portion and having a top plate, a mediate section, and a lower section. A passage is longitudinally defined through the mediate section of the body. Two channels are each longitudinally defined in the top section of the body and each terminate at the first closed end portion thereof.

Two grooves are each longitudinally defined in the top plate of the top section of the body, each groove is defined by two sides, and each communicates with a corresponding one of the two channels. A flange is longitudinally formed on the top plate and is located between the two grooves. A plurality of wedge-shaped teeth are formed on each of the two sides of each of the two grooves.

Two elongated rods are each disposed in a corresponding one of the two channels and located below an associated groove, and each have one distal end fixedly mounted on the first closed end portion of the top section of the body.

Further features of the present invention will become apparent from a careful reading of the subsequent detailed descriptions with reference to accompanying drawings.

DETAILED DESCRIPTION OF THE PREFERRED EMBODIMENTS

Figure 1:
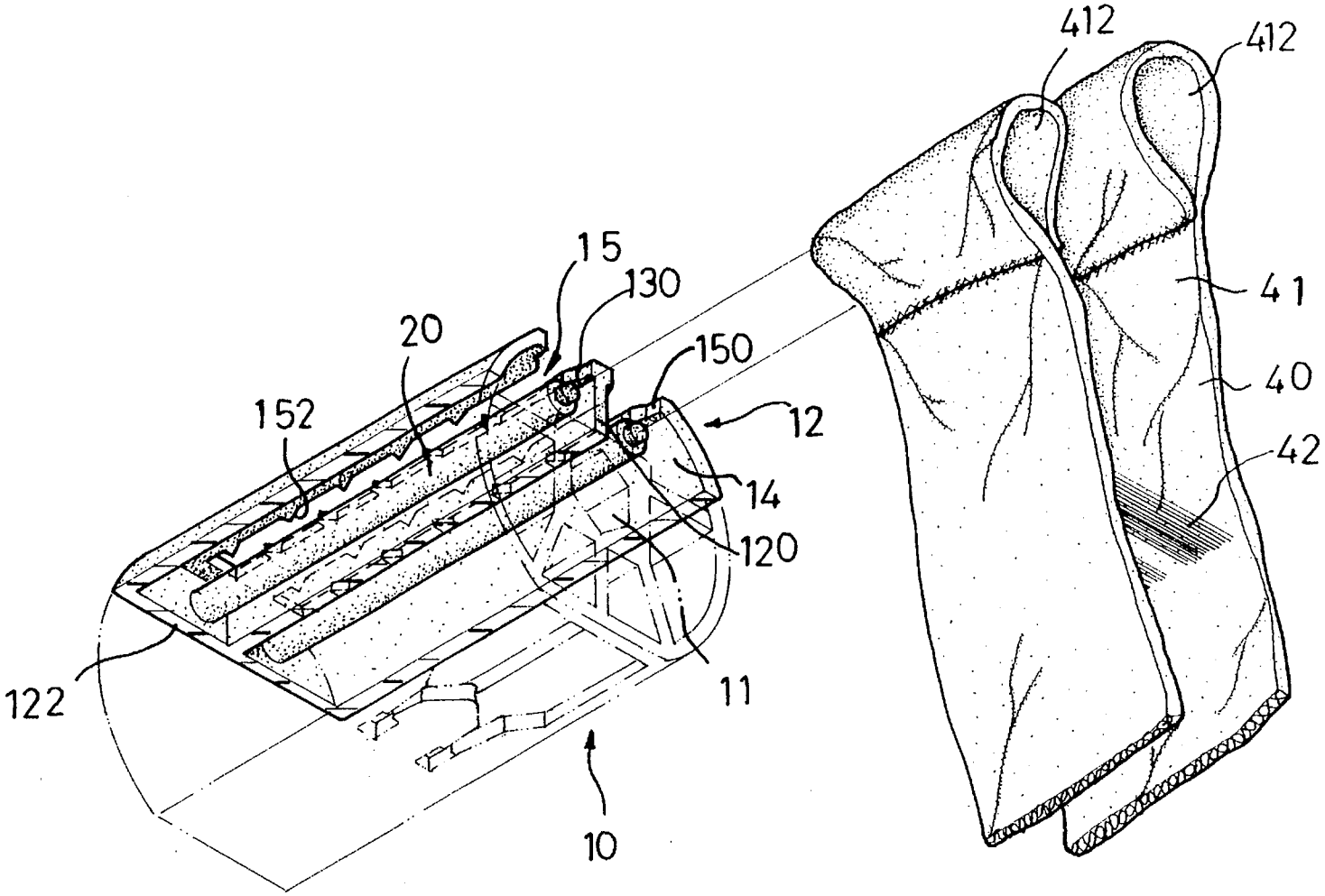
FIG. 1 is an exploded view of a positioning drum device in accordance with the present invention.
Figure 2:
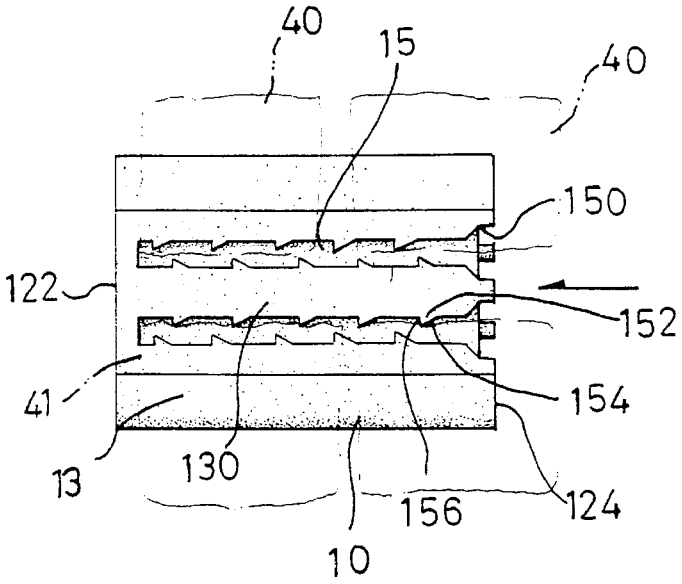
FIG. 2 is a top plan view of FIG. 1.
Figure 3:
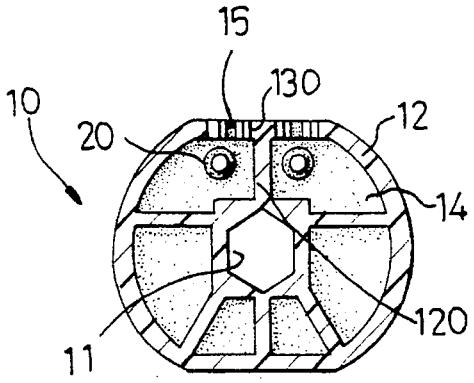
FIG. 3 is a side cross-sectional view of FIG. 1.
Figure 6:
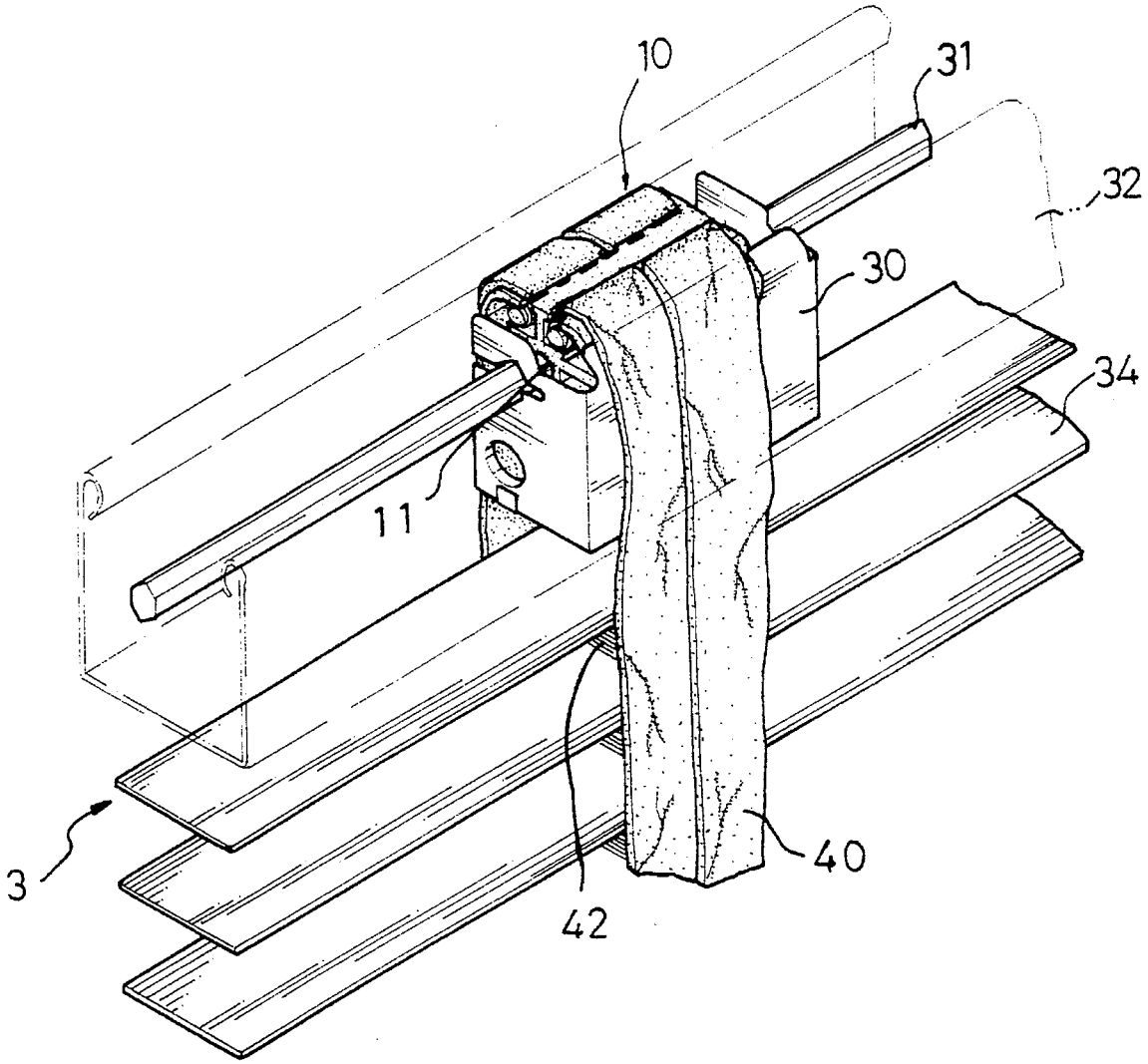
FIG. 6 is a perspective assembly view showing the positioning drum device in combination with a Venetian blind.

Referring to the drawings and initially to FIGS. 1–3 with reference to FIG. 6, a positioning drum device in accordance with the present invention is provided for a Venetian blind 3 which comprises a headrail 32 having a substantially U-shaped cross-section, and at least one positioning base 30 fixedly mounted in the headrail 32.

The positioning drum device is rotatably mounted in the positioning base 30 and comprises a body 10 including a hollow top section 12 having a first closed end portion 122 and a second open end portion 124 and having a top plate 13, a mediate section, and a lower section.

An axial passage 11 is longitudinally defined through the mediate section of the body 10, and an elongated control rod 31 extends through the axial passage 11 so as to control angular movement and rotational angles of the body 10 of the positioning drum device.

Two channels 14 are each longitudinally defined in the top section 12 of the body 10. Preferably, each of the two channels 14 initiates at the second open end portion 124 of the top section 12 of the body 10 and terminates at the first closed end portion 122 thereof.

Two grooves 15 are each longitudinally defined in the top plate 13 of the top section 12 of the body 10, each groove is defined by two sides communicates with a corresponding one of the two channels 14. Correspondingly, each of the two grooves 15 initiates at the second open end portion 124 of the top section 12 of the body 10 and terminates at the first closed end portion 122 thereof.

A flange 130 is longitudinally formed on the top plate 13 and is located between the two grooves 15. Preferably, a reinforced baffle 120 is formed on the top section 12 of the body 10 located between the two channels 14 and is fixedly mounted or formed on an underside of the flange 130.

A flared portion 150 is formed on each of the two sides of each of the two grooves 15 and is located at the second open end portion 124 of the top section 12 of the body 10. A plurality of wedge-shaped teeth 152 are formed on each of the two sides defining each of the two grooves 15. Preferably, each of the teeth 152 has a ramp 154 facing the open end portion 124 of the top section 12 of the body 10 and has a right-angled stop surface 156 facing the closed end portion 122 thereof.

Two elongated supporting rods 20 are each disposed in a corresponding one of the two channels 14 and located below an associated groove 15, and each have one distal end fixedly mounted or formed on the first closed end portion 122 of the top section 12 of the body 10.

Figure 4:
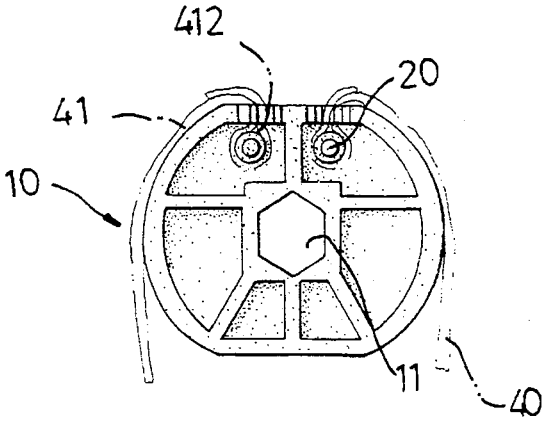
FIG. 4 is an assembly view of FIG. 3.
Figure 5:
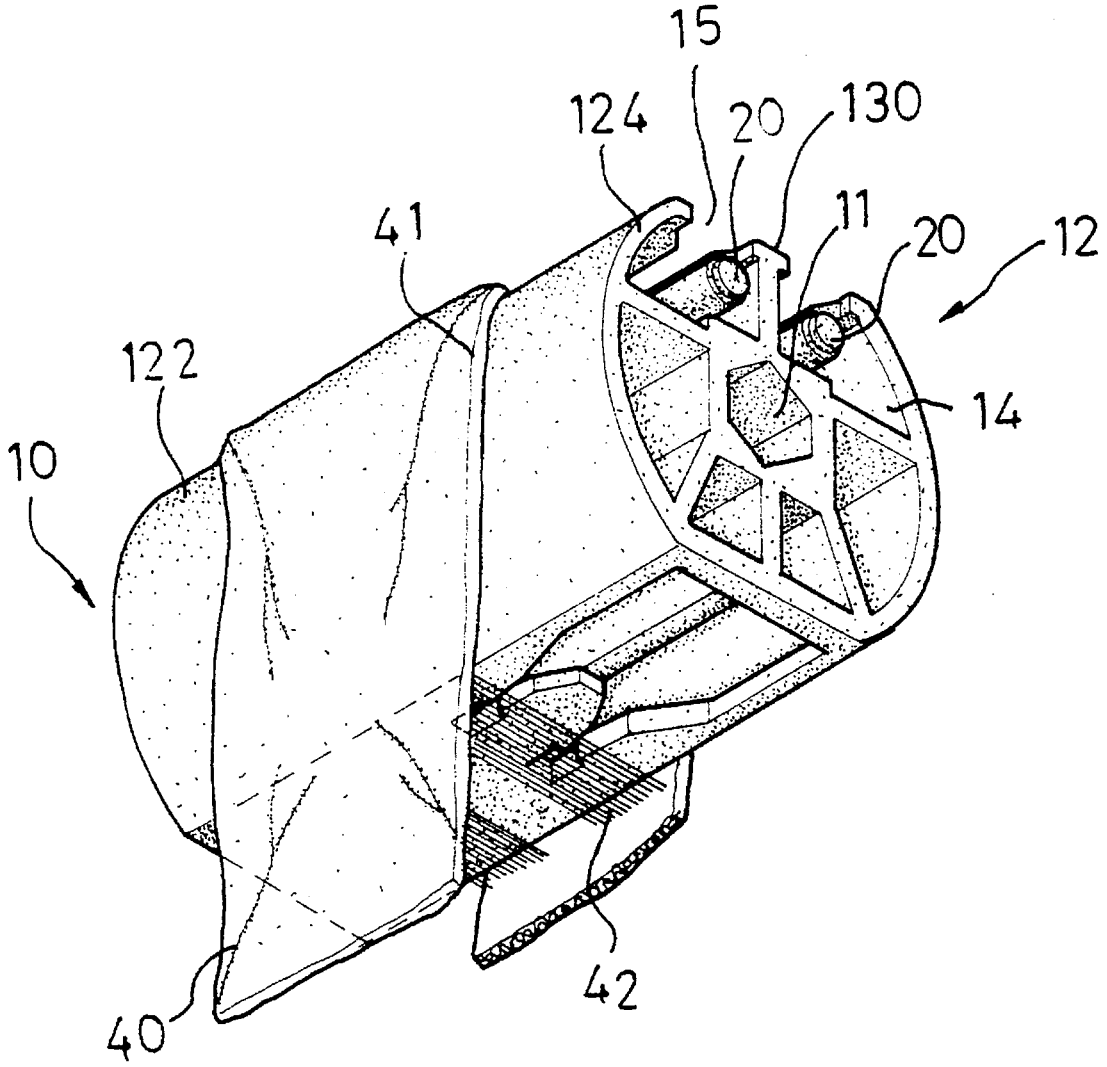
FIG. 5 is a perspective assembly view of FIG. 1.

In assembly, referring to FIGS. 4–6 with reference to FIG. 1, two flexible tapes 40 each include a first free end 41 having a loop 412 formed thereon. The loop 412 of each of the two flexible tapes 40 is inserted into a corresponding one of the two channels 14 and is enclosed around an associated elongated supporting rod 20 while the first free end 41 of each of the two tapes 40 is introduced from a corresponding flared portion 150 into an associated groove 15, thereby being retained by the plurality of wedge-shaped teeth 152, and is prevented from being released from the teeth 152 by means of the stop surfaces 156 thereof.

Each of the two flexible tapes 40 also includes a second free end extending downwardly from which a plurality of supporting webs 42 extend therebetween for supporting a corresponding plurality of slats 34 thereon so as to control angular movement and rotational angles of the plurality of slats.

It should be clear to those skilled in the art that further embodiments of the present invention may be made without departing from the scope and the spirit of the present invention.

What is claimed is:

1. A positioning drum device for a Venetian blind (3) which comprises a headrail (32) having a substantially U-shaped cross-section, at least one positioning base (30) fixedly mounted in said headrail (32), said positioning drum device rotatably mounted in said positioning base (30) and comprising a body (10) which includes a hollow top section (12) having a first closed end portion (122) and a second open end portion (124) and having a top plate (13), a mediate section, and a lower section, a passage (11) longitudinally defined through the mediate section of said body (10), two channels (14) each longitudinally defined in the top section (12) of said body (10) and each terminating at the first closed end portion (122) thereof, two grooves (15) each longitudinally defined in said top plate (13) of said top section (12) of said body (10), each being defined by two sides, and each communicating with a corresponding one of said two channels (14), a flange (130) longitudinally formed on said top plate (13) and located between said two grooves (15), a plurality of wedge-shaped teeth (152) formed on each of the two sides of each of said two grooves (15), and two elongated rods (20) each disposed in a corresponding one of said two channels (14) and located below an associated groove (15), and each having one distal end fixedly mounted on the first closed end portion (122) of the top section (12) of said body (10).

2. The positioning drum device in accordance with claim 1, wherein a reinforced baffle (120) is formed on the top section (12) of said body (10) located between said two channels (14) and is fixedly mounted on an underside of said flange (130).

3. The positioning drum device in accordance with claim 1, wherein a flared portion (150) is formed on each of the two sides defining each of said two grooves (15) and is located at the second open end portion (124) of the top section (12) of said body (10).

* * * * *